US008164563B2

(12) United States Patent
Liu et al.

(10) Patent No.: US 8,164,563 B2
(45) Date of Patent: Apr. 24, 2012

(54) DATA MULTIPLEXER ARCHITECTURE FOR REALIZING DOT INVERSION MODE FOR USE IN A LIQUID CRYSTAL DISPLAY DEVICE AND ASSOCIATED DRIVING METHOD

(75) Inventors: Sheng-chao Liu, Hsin-Chu (TW); Chen-ming Chen, Hsin-Chu (TW); Yung-chan Chou, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 979 days.

(21) Appl. No.: 12/136,261

(22) Filed: Jun. 10, 2008

(65) Prior Publication Data

US 2009/0231363 A1 Sep. 17, 2009

(30) Foreign Application Priority Data

Mar. 12, 2008 (TW) ..... 97108757 A

(51) Int. Cl.
*G09G 5/10* (2006.01)
*G09G 3/36* (2006.01)

(52) U.S. Cl. ..... 345/100; 345/96; 345/103

(58) Field of Classification Search ..... 345/690, 345/96, 55, 209, 54, 100, 103
See application file for complete search history.

(56) References Cited

U.S. PATENT DOCUMENTS

| | | | | |
|---|---|---|---|---|
| 6,281,891 | B1 | 8/2001 | Dacosta et al. | |
| 6,417,827 | B1 | 7/2002 | Nagao et al. | |
| 6,985,130 | B2 * | 1/2006 | Nakayoshi et al. | 345/100 |
| 7,038,652 | B2 | 5/2006 | Kang et al. | |
| 7,605,830 | B2 * | 10/2009 | Date | 345/690 |
| 2004/0080701 | A1 | 4/2004 | Shih | |
| 2005/0140633 | A1 | 6/2005 | Kato | |
| 2008/0180369 | A1 * | 7/2008 | Chiu et al. | 345/87 |
| 2009/0231363 | A1 * | 9/2009 | Liu et al. | 345/690 |

FOREIGN PATENT DOCUMENTS

TW 559748 11/2003

* cited by examiner

*Primary Examiner* — Quan-Zhen Wang
*Assistant Examiner* — Michael J Eurice
(74) *Attorney, Agent, or Firm* — Kirton McConkie; Evan R. Witt

(57) ABSTRACT

A liquid crystal display device includes a gate driver for generating a first scan signal voltage and a second scan signal voltage, a source driver for generating a first polarity data voltage and a second polarity data voltage, and a liquid crystal display panel having a first pixel set and a second pixel set. Each first and second pixel set includes a first pixel and a second pixel. Both the first pixel of the first pixel set and the second pixel of the second pixel set display grey level based on the first polarity data voltage in response to the first scan signal voltage. Both the second pixel of the first pixel set and the first pixel of the second pixel set display grey level based on the second polarity data voltage in response to the second scan signal voltage.

3 Claims, 5 Drawing Sheets

DATA MULTIPLEXER ARCHITECTURE FOR REALIZING DOT INVERSION MODE FOR USE IN A LIQUID CRYSTAL DISPLAY DEVICE AND ASSOCIATED DRIVING METHOD

BACKGROUND OF THE INVENTION

1. Field of the Invention

The present invention relates to a liquid crystal display device, and more particularly, to a liquid crystal display device using multiplexers capable of providing an improvement of line mura between pixels.

2. Description of Prior Art

More and more advanced-function displays have found their applications in current consumer electronic products. In particular, liquid crystal displays (LCDs) having a high-resolution color screen, are more widely applied in various electronic devices, such as televisions, mobile phones, personal digital assistances (PDA), digital cameras, desktop computer screens, and notebook computer screens.

Referring to FIG. 1 showing a functional block diagram of a prior art liquid crystal display device 10, the conventional liquid crystal display device 10 contains a liquid crystal panel 12, a gate driver 14, and a source driver 16. The liquid crystal panel 12 includes a plurality of pixels, each pixel having three pixel units 20 indicating three primary colors, red, green, and blue. For example, the liquid crystal display 12 with 1024 by 768 pixels contains 1024×768×3 pixel units 20. The gate driver 14 periodically outputs a scanning signal to turn on each transistor of the pixel units 20 row by row, meanwhile, each pixel units 20 is charged to a corresponding voltage based on a data signal from the source driver 16, to show various gray levels. After a row of pixel units is finished to be charged, the gate driver 14 stops outputting the scanning signal to this row, and then outputs the scanning signal to turn on the transistors of the pixel units of the next row. Sequentially, until all pixel units 20 of the liquid crystal panel 12 finish charging, and the gate driver 14 outputs the scanning signal to the first row again and repeats the above-mentioned mechanism.

As to the conventional liquid crystal display, the gate driver 14 functions as a shift register. In other words, the gate driver 16 outputs a scanning signal to the liquid crystal display 12 at a fixed interval. For instance, a liquid crystal display 12 with 1024×768 pixels and its operating frequency with 60 Hz is provided, the display interval of each frame is about 16.67 ms (i.e., 1/60 second), such that an interval between two scanning signals applied on two row adjacent lines is about 21.7 μs (i.e., 16.67 ms/768). The pixel units 20 are charged and discharged by data voltage from the source driver 16 to show corresponding gray levels in the time period of 21.7 μs accordingly.

In general, as a skilled person in this art is aware, the voltage across the two electrodes has two polarities. A voltage of the pixel electrode larger than that of the common electrode is called positive polarity, and inversely, a voltage of the common electrode larger than that of the pixel electrode is called negative polarity. If absolute values of the voltage difference across the two electrodes are identical, no matter whether the voltage value of the pixel electrode or that of the common electrode is higher, an identical gray level is obtained. However, in fact, opposed voltage difference value across the two electrodes results in the opposed alignments of the liquid crystal molecules.

From a view of long-term sum effect, if the voltage across the two electrodes tends toward either polarity for a while, the common voltage applied on the common electrode causes a voltage-drifting phenomenon. Consequently, the alignment of the liquid crystal molecules fails to be varied based on the required control voltage, resulting in displaying incorrect gray levels. In an extreme situation, it is possible that if the voltage across the two electrodes tends toward either polarity for a long while, even if no voltage is applied, the liquid crystal molecules still fail to be aligned based on a variety of electrical fields. As a result, in order to prevent the common voltage from experiencing the voltage-drifting phenomenon as the voltage applied across the two electrodes tends toward any polarity, the voltages across the two electrodes are periodically switched between positive polarity and negative polarity. Dot inversion mode, by which each pixel unit alternately varies polarity and its neighbor pixels have inversed polarities all the time, is widely used for periodically driving the voltage across the liquid crystal molecules.

With reference to FIG. 1 showing an LCD panel according to prior art, and FIG. 2 illustrating a schematic diagram of the LCD panel using dot inversion mode alternately varying polarity, the LCD panel 12 comprises a plurality of first pixel groups and a plurality of second pixel groups. Each first pixel group comprises six pixel units R11, R12, G11, G12, B11, and B12; each second pixel group comprises six pixel units R21, R22, G21, G22, B21, and B22. The pixels R11, R12, R21, R22 are indicated to show red, the pixels G11, G12, G21, G22 are indicated to show green, and the pixels B11, B12, B21, B22 are indicated to show blue. Each first pixel group is coupled to a first polarity data voltage S1 via a first multiplexer 26, while each second pixel group is coupled to a second polarity data voltage S2 via a second multiplexer 28. Herein, the conventional LCD panel having 1 to 6 multiplexers configuration may improve display quality and reduce a number of output pins of source drivers to lower cost.

Considering the first pixel group, switch units SW11, SW12, SW13, SW14, SW15, and SW16 are coupled to pixel unit R11, G11, B11, R12, G12, and B12, respectively. Considering the second pixel group, switch units SW21, SW22, SW23, SW24, SW25, and SW26 are coupled to pixel R21, G21, B21, R22, G22, B22, respectively. The switch units SW11, SW21 are controlled by scan signal voltage SCAN1. The switch units SW12, SW22 are controlled by scan signal voltage SCAN2. The switch units SW13, SW23 are controlled by scan signal voltage SCAN3. The switch units SW14, SW24 are controlled by scan signal voltage SCAN4. The switch units SW15, SW25 are controlled by scan signal voltage SCAN5. The switch units SW16, SW26 are controlled by scan signal voltage SCAN6.

During an interval t1, when the switch unit SW11, SW21 turns on in response to the scan signal voltage SCAN1, the pixel unit R11 of the first pixel group, and the pixel unit R21 of the second pixel group shows corresponding grey levels based on the polarity signal voltage S1, S2, respectively. During an interval t2, when the switch unit SWT2, SW22 turns on in response to the scan signal voltage SCAN2, the pixel unit G11 of the first pixel group, and the pixel unit G21 of the second pixel group shows corresponding grey levels based on the polarity signal voltage S1, S2, respectively. During an interval t3, when the switch unit SW13, SW23 turns on in response to the scan signal voltage SCAN3, the pixel unit B11 of the first pixel group, and the pixel unit B21 of the second pixel group shows corresponding grey levels based on the polarity signal voltage S1, S2, respectively. During an interval t4, when the switch unit SW14, SW24 turns on in response to the scan signal voltage SCAN4, the pixel unit R12 of the first pixel group, and the pixel unit R22 of the second pixel group shows corresponding grey levels based on the polarity signal voltage S1, S2, respectively.

During an interval t5, when the switch unit SW15, SW25 turns on in response to the scan signal voltage SCAN5, the pixel unit G12 of the first pixel group, and the pixel unit G22 of the second pixel group shows corresponding grey levels based on the polarity signal voltage S1, S2, respectively. During an interval t6, when the switch unit SW16, SW26 turns on in response to the scan signal voltage SCAN6, the pixel unit B12 of the first pixel group, and the pixel unit B22 of the second pixel group shows corresponding grey levels based on the polarity signal voltage S1, S2, respectively.

Nevertheless, as shown in FIG. 2, under dot inversion mode incorporating with 1 to 6 multiplexer scheme, the pixel units B12 and R21 always have identical polarity, leading a junction between the pixel units B12 and R21 to a failure of dot inversion, and thereby line mura effect across the pixel units B12 and R21.

SUMMARY OF THE INVENTION

It is therefore an objective of the claimed invention to provide a LCD device and a related driving method to provide an improvement of crosstalk between pixels, so as to solve the above-mentioned problem.

Briefly summarized, the present invention provides a liquid crystal display (LCD) device. The LCD device comprises a gate driver, a source driver, and a LCD panel. The gate driver is used for generating a first scan signal voltage and a second scan signal voltage. The source driver is used for generating a first polarity data voltage and a second data voltage. The liquid crystal display panel comprises a plurality of first pixel groups and a plurality of second pixel groups. Each first pixel group and each second pixel group comprise a first pixel unit and a second pixel unit. Both the first pixel unit of each first pixel group and the second pixel unit of each second pixel group show grey level based on the first polarity data voltage, when receiving the first scan signal voltage. Both the second pixel unit of each first pixel group and the first pixel unit of each second pixel group show grey levels based on the second polarity data voltage, when receiving the second scan signal voltage.

According to the present invention, a method of driving a LCD panel is provided. The LCD panel comprises a plurality of first pixel groups and a plurality of second pixel groups. Each first pixel group and each second pixel group comprise a first pixel unit and a second pixel unit. The method comprises the following steps: generating a first scan signal voltage and a second scan signal voltage in order; generating a first polarity data voltage and a second data voltage, wherein a polarity of the first polarity data voltage is inversed to that of second polarity data voltage; at a first moment both the first pixel unit of each first pixel group and the second pixel unit of each second pixel group show grey level based on the first polarity data voltage, when receiving the first scan signal voltage; and at a second moment both the second pixel unit of each first pixel group and the first pixel unit of each second pixel group show grey levels based on the second polarity data voltage, when receiving the second scan signal voltage.

These and other objectives of the claimed invention will no doubt become obvious to those of ordinary skill in the art after reading the following detailed description of the preferred embodiment that is illustrated in the various figures and drawings.

DETAILED DESCRIPTION OF THE INVENTION

Figure 1:
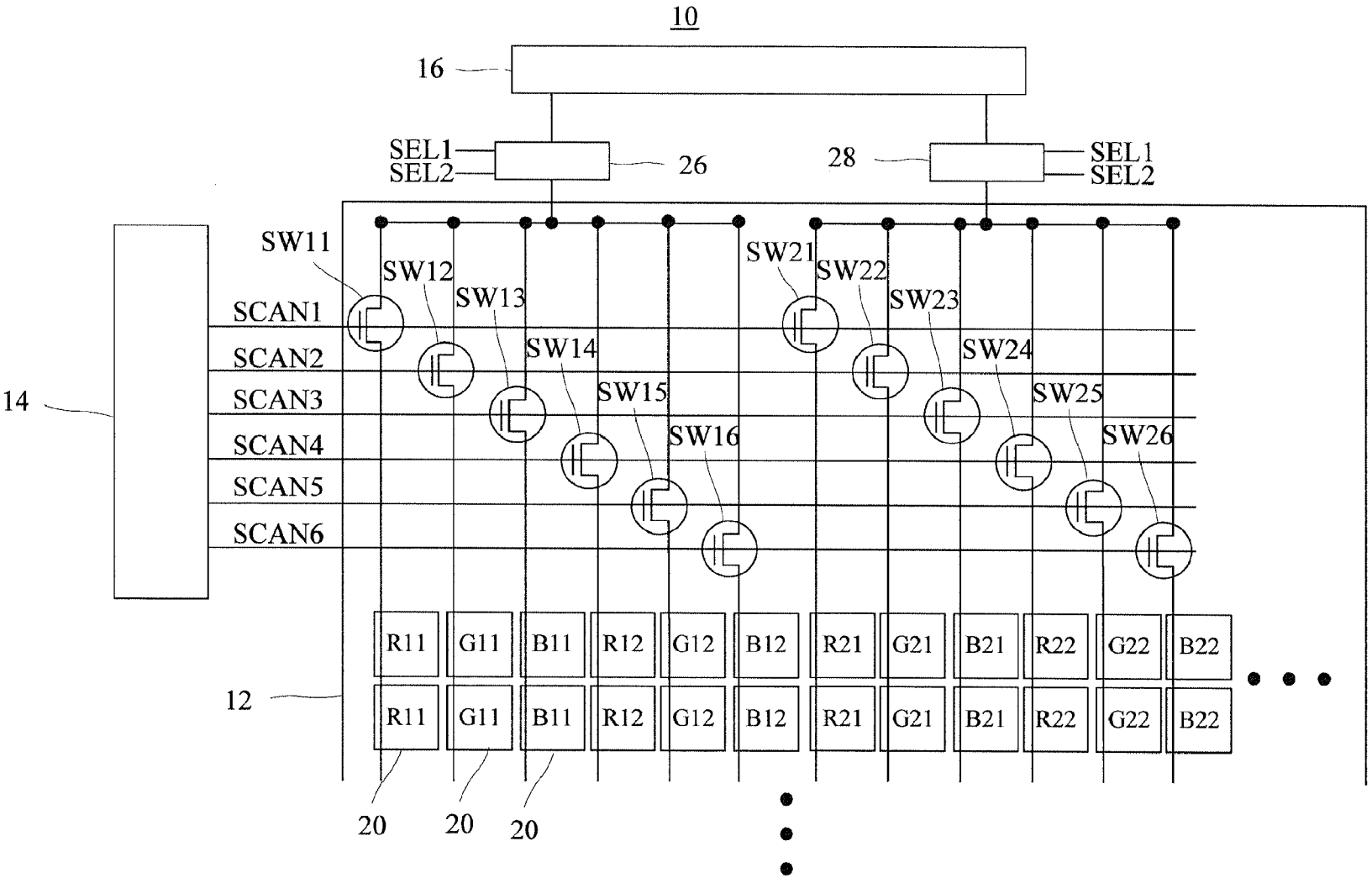
FIG. 1 (PRIOR ART)
FIG. 1 shows an LCD panel according to prior art.
Figure 2:
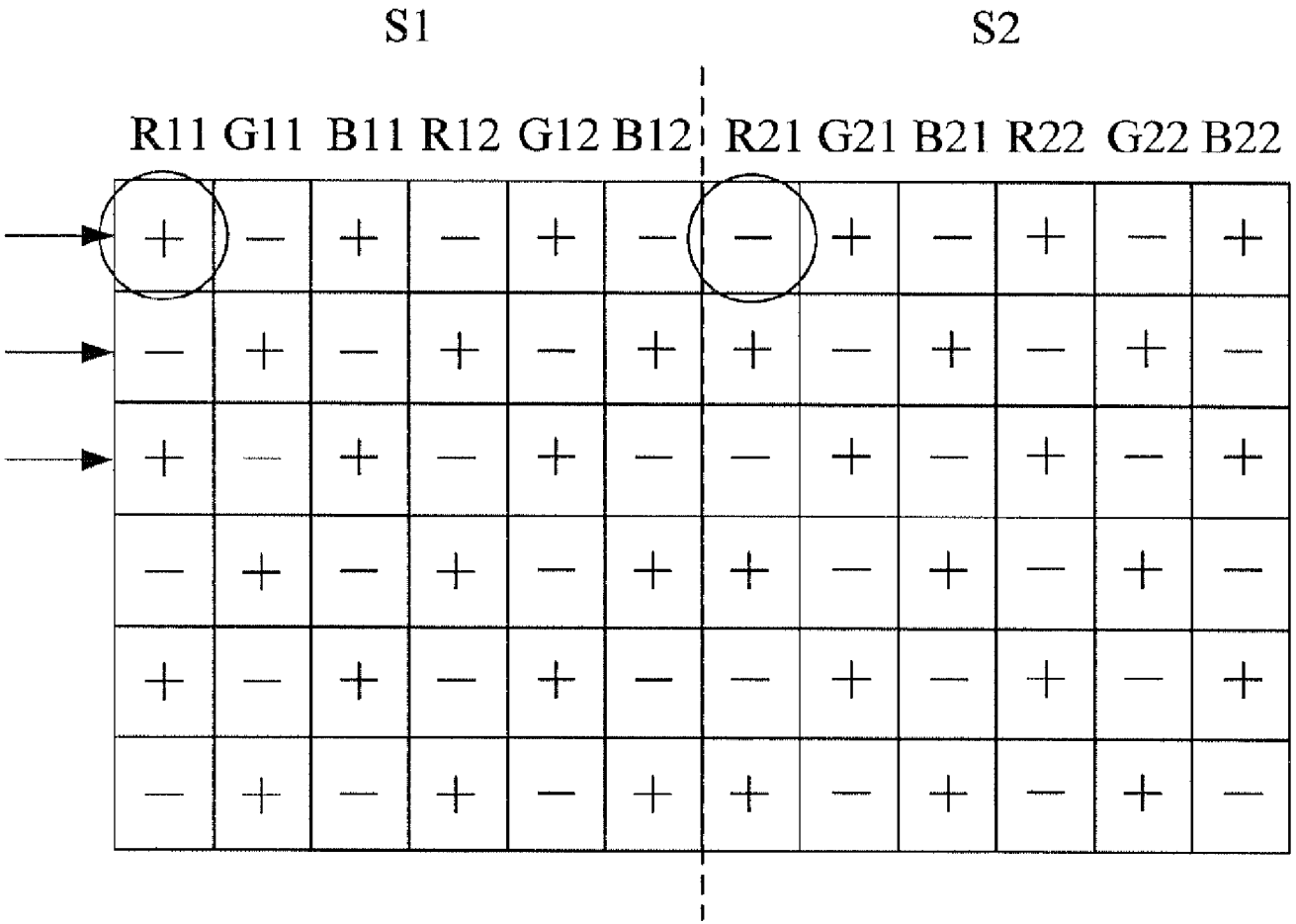
FIG. 2 (PRIOR ART)
FIG. 2 illustrates a schematic diagram of the LCD panel using dot inversion mode alternately varying polarity.
Figure 3:
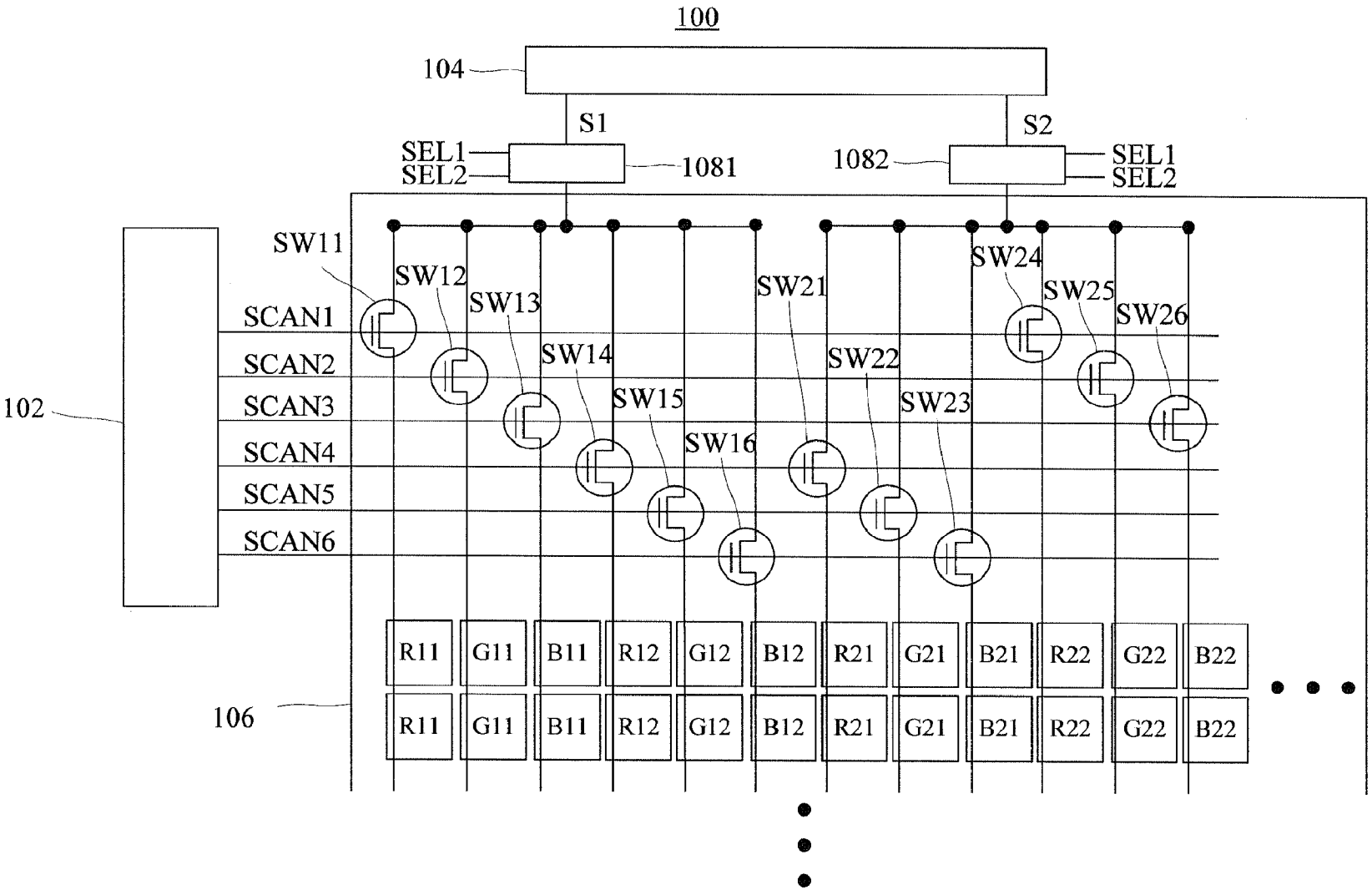
FIG. 3 shows a liquid crystal display device according to a first embodiment of the present invention.

Referring to FIG. 3 showing a liquid crystal display (LCD) device 100 according to a first embodiment of the present invention, the liquid crystal display device 100 comprises a gate driver 102, a source driver 104, and a liquid crystal panel 106. The gate driver 102 is used for generating scan signal voltage, and the source driver 104 is used for generating polarity of data voltage S1, S2. The liquid crystal panel 106 comprises a plurality of first pixel groups and a plurality of second pixel groups. Each first pixel group comprises six pixel units R11, R12, G1, G12, B11, and B12; each second pixel group comprises six pixel units R21, R22, G21, G22, B21, and B22. The pixels R11, R12, R21, R22 are indicated to show red, the pixels G11, G12, G21, G22 are indicated to show green, and the pixels B11, B12, B21, B22 are indicated to show blue. The LCD device 100 further comprises a plurality of first multiplexers 1081 and a plurality of second multiplexers 1082. Each first pixel group is coupled to a first polarity data voltage S1 via a first multiplexer 1081, while each second pixel group is coupled to a second polarity data voltage S2 via a second multiplexer 1082.

In this embodiment, considering the first pixel group, switch units SW11, SW12, SW13, SW14, SW15, and SW16 are coupled to pixel unit R11, G11, B11, R12, G12, and B12, respectively. Considering the second pixel group, switch units SW21, SW22, SW23, SW24, SW25, and SW26 are coupled to pixel R21, G21, B21, R22, G22, B22, respectively. It is noted that the switch units SW11, SW24 are controlled by scan signal voltage SCAN1; the switch units SW12, SW25 are controlled by scan signal voltage SCAN2; the switch units SW13, SW26 are controlled by scan signal voltage SCAN3; the switch units SW14, SW21 are controlled by scan signal voltage SCAN4; the switch units SW15, SW22 are controlled by scan signal voltage SCAN5; and the switch units SW16, SW23 are controlled by scan signal voltage SCAN6.

Figure 4:
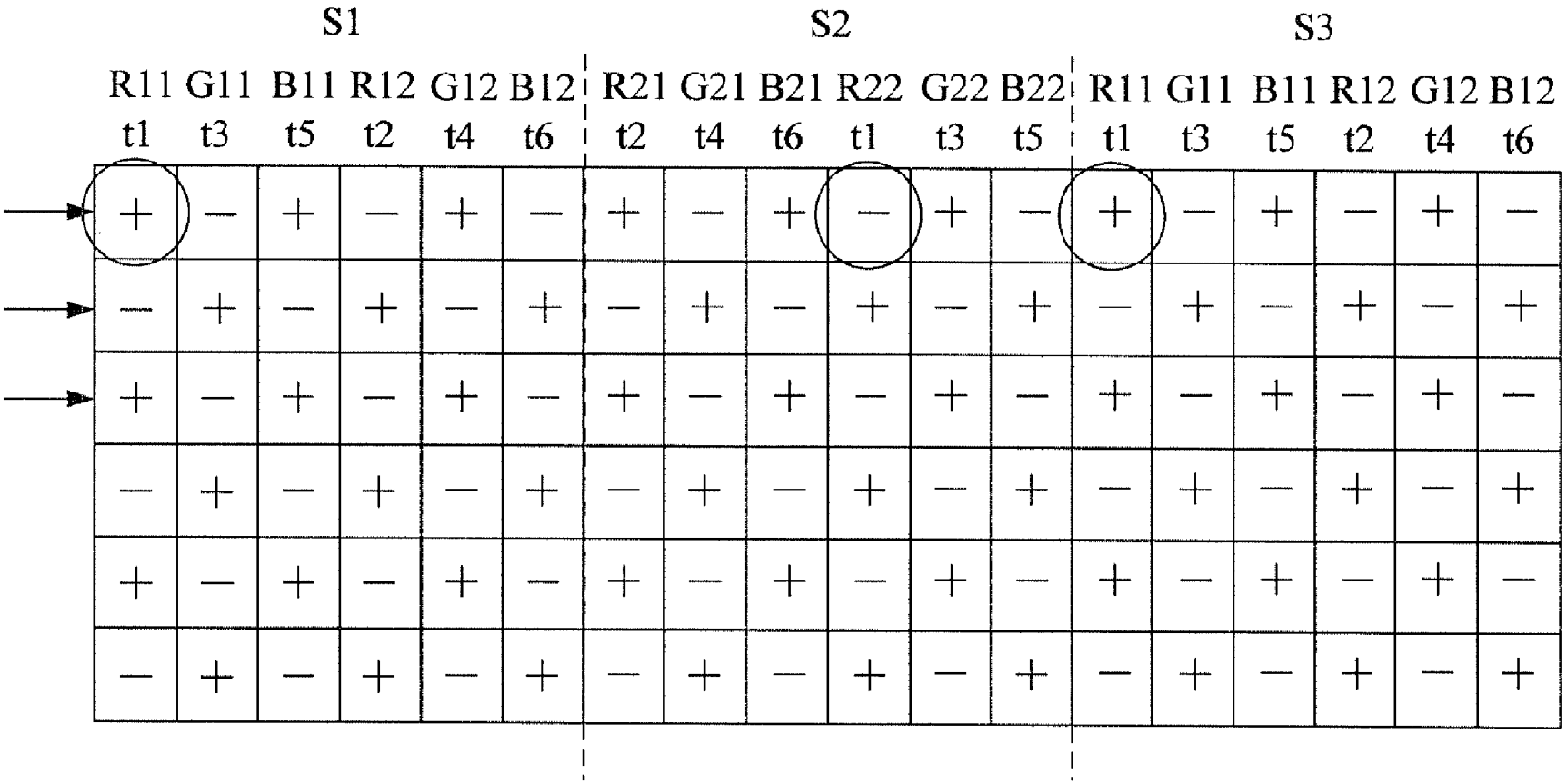
FIG. 4 illustrates a schematic diagram of the LCD device of the present invention using dot inversion mode alternately varying polarity.

Referring to FIG. 3 in conjunction to FIG. 4 illustrating a schematic diagram of the LCD device of the present invention using dot inversion mode alternately varying polarity, during an interval t1, when the switch unit SW11, SW24 turns on in response to the scan signal voltage SCAN™, the pixel unit R11 of the first pixel group, and the pixel unit R21 of the second pixel group shows corresponding grey levels based on the polarity signal voltage S1, S2 from the source driver 104, respectively. During an interval t2, when the switch unit SW12, SW25 turns on in response to the scan signal voltage SCAN2, the pixel unit G11 of the first pixel group, and the pixel unit G21 of the second pixel group shows corresponding grey levels based on the polarity signal voltage S1, S2 from the source driver 104, respectively. During an interval t3, when the switch unit SW13, SW26 turns on in response to the scan signal voltage SCAN3, the pixel unit B11 of the first pixel group, and the pixel unit B21 of the second pixel group shows corresponding grey levels based on the polarity signal voltage S1, S2 from the source driver 104, respectively. During an interval t4, when the switch unit SW14, SW21 turns on in response to the scan signal voltage SCAN4, the pixel unit R12 of the first pixel group, and the pixel unit R22 of the second pixel group shows corresponding grey levels based on the polarity signal voltage S1, S2 from the source driver 104, respectively. During an interval t5, when the switch unit SW15, SW23 turns on in response to the scan signal voltage SCAN5, the pixel unit G12 of the first pixel group, and the pixel unit G22 of the second pixel group shows corresponding grey levels based on the polarity signal voltage S1, S2 from the source driver 104, respectively. During an interval t6, when the switch unit SW16, SW23 turns on in response to the scan signal voltage SCAN6, the pixel unit B12 of the first pixel group, and the pixel unit B22 of the second pixel group shows corresponding grey levels based on the polarity signal voltage S1, S2 from the source driver 104, respectively.

The first multiplexer 1081 outputs the first polarity data voltage S1 to the pixel units R11, B11, and G12 of the first pixel group in response to the first selecting signal SEL1, or outputs the second polarity data voltage S2 to the pixel units G11, R12, and B12 of the first pixel group in response to the second selecting signal SEL2. The second multiplexer 1082 outputs the second polarity data voltage S2 to the pixel units R21, B21, and G22 of the second pixel group in response to the first selecting signal SEL1, or outputs the second polarity data voltage S2 to the pixel units G21, R22, and B22 of the second pixel group in response to the second selecting signal SEL2. It is noted that the first polarity data voltage S1 in response to the first selecting signal SEL1 has inversed polarity to that in response to the second selecting signal SEL2. For example, the first polarity data voltage S1 in response to the first selecting signal SEL1 is positive polarity, while the first polarity data voltage S1 in response to the second selecting signal SEL2 is negative polarity. Conversely, the first polarity data voltage S1 in response to the first selecting signal SEL1 is negative polarity, while the first polarity data voltage S1 in response to the second selecting signal SEL2 is positive polarity. Similarly, the second polarity data voltage S2 in response to the first selecting signal SEL1 has inversed polarity to that in response to the second selecting signal SEL2.

Figure 5:
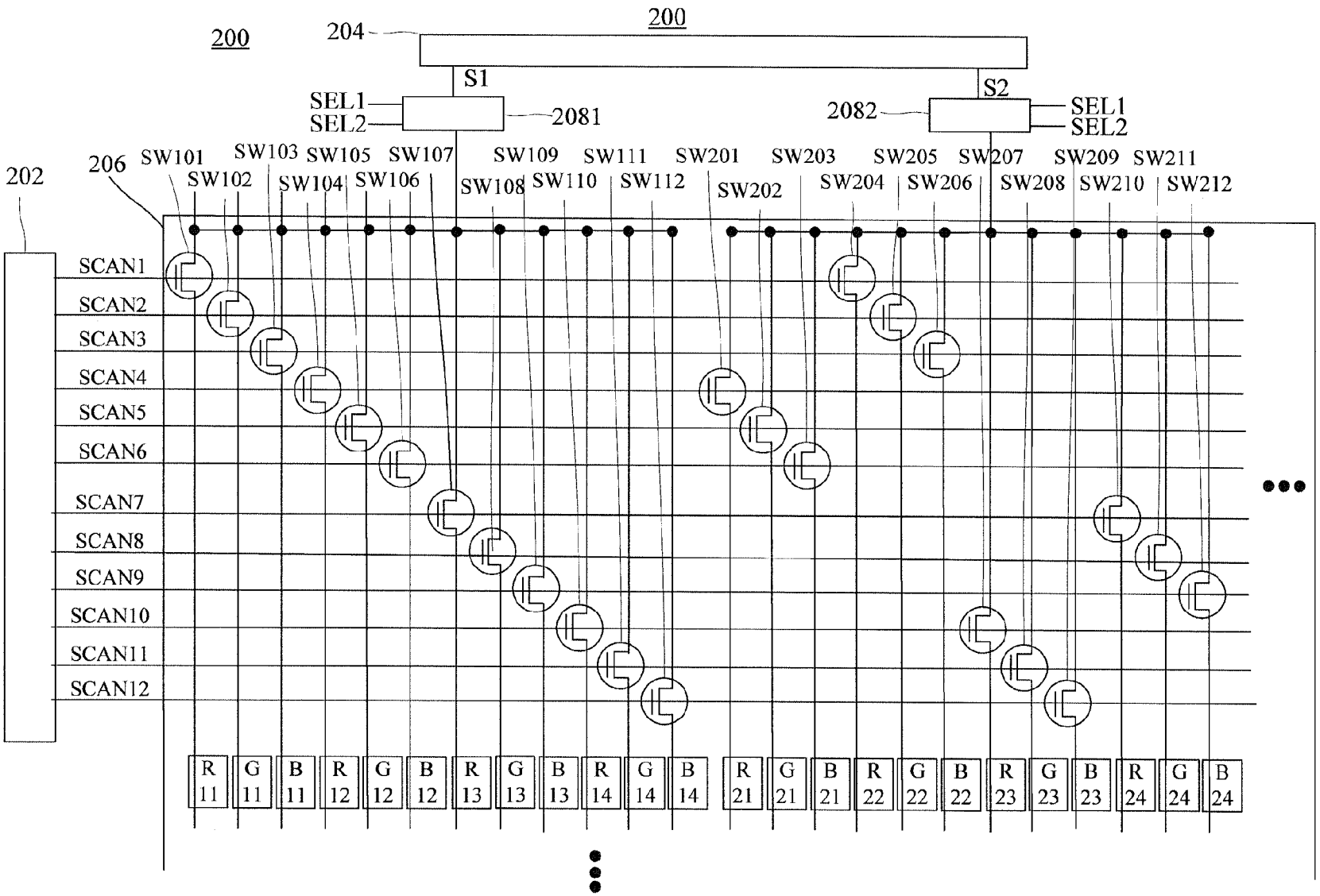
FIG. 5 shows an LCD device according to a second embodiment of the present invention.

Referring to FIG. 5 showing an LCD device according to a second embodiment of the present invention, the liquid crystal display device 200 comprises a gate driver 202, a source driver 204, a plurality of first multiplexers 2081 and a plurality of second multiplexers 2082, and a liquid crystal panel 206. The gate driver 202 is used for generating scan signal voltage, and the source driver 204 is used for generating polarity of data voltage S1, S2. The liquid crystal panel 206 comprises a plurality of first pixel groups and a plurality of second pixel groups. Differing from the LCD device 100, the LCD device 200 according to the second embodiment, each first pixel group comprises twelve pixel units R11, G11, B11, R12, G12, B12, R13, G13, B13, R14, G14, and B14; each second pixel group comprises twelve pixel units R21, G21, B21, R22, G22, B22, R23, G23, B23, R24, G24, and B24. Each first pixel group is coupled to a first polarity data voltage S1 via a first multiplexer 2081, while each second pixel group is coupled to a second polarity data voltage S2 via a second multiplexer 2082. In other words, a use of 1 to 12 multiplexers is also allowed to achieve the purpose of the present invention.

Please note that the functional block diagram of the LCD devices 100, 200 shown in FIG. 3 and FIG. 5 respectively are examples of the present invention and should not be interpreted as restricting conditions in the present invention. The number of pixel units controlled by the multiplexer depends on the design demand, and 12, 18 . . . , or 6*N (N=1, 2, 3 . . . ) pixel units and 1 to 6*N multiplexer known by the skilled in this art are also allowed and should be within the scope of the present invention.

In contrast to prior art, the present inventive LCD device incorporating 1 to 6*N multiplexer scheme can provide an improvement of line mura between pixel units under dot inversion mode.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A liquid crystal display (LCD) device, comprising:

a plurality of data lines arranged in parallel, comprising a (6m−5)th data line, a (6m−4)th data line, a (6m−3)th data line, a (6m−2)th data line, a (6m−1)th data line, and a (6m)th data line, a (6n−5)th data line, a (6n−4)th data line, a (6n−3)th data line, a (6n−2)th data line, a (6n−1)th data line, and a (6n)th data line, wherein the (6m+i)th data line is between the (6m+i−1)th data line and the (6m+i+1)th data line, the (6n+i)th data line is between the (6n+i−1)th data line and the (6n+i+1)th data line, where m, n are positive integrates, m does not equal to n, and i =1, 2, 3, 4;

a plurality of scan lines arranged in parallel, comprising a (6p−5)th scan line, a (6p−4)th scan line, a (6p−3)th scan line, a (6p−2)th scan line, a (6p−1)th scan line, and a (6p)th scan line, wherein the (6p+j)th scan line is between the (6p+j−1)th scan line and the (6p+j+1)th scan line, where p is a positive integrate, and j =1, 2, 3, 4;

a liquid crystal display panel, comprising:

a first pixel group comprising a first pixel unit, a second pixel unit, a third pixel unit, a fourth pixel unit, a fifth pixel unit, and a sixth pixel unit;

a second pixel group, comprising a seventh pixel unit, an eighth pixel unit, a ninth pixel unit, a tenth pixel unit, an eleventh pixel unit, and a twelfth pixel unit, wherein the first pixel unit is coupled to the (6p−5)th scan line and the (6m−5)th data line, the second pixel unit is coupled to the (6p−4)th scan line and the (6m−4)th data line, the third pixel unit is coupled to the (6p−3)th scan line and the (6m−3)th data line, the fourth pixel unit is coupled to the (6p−2)th scan line and the (6m−2)th data line, the fifth pixel unit is coupled to the (6p−1)th scan line and the (6m−1)th data line, the sixth pixel unit is coupled to the (6p)th scan line and the (6m)th data line, the seventh pixel unit is coupled to the (6p−2)th scan line and the (6n−5)th data line, the eighth pixel unit is coupled to the (6p−1)th scan line and the (6n−4)th data line, the ninth pixel unit is coupled to the (6p)th scan line and the (6n−3)th data line, the tenth pixel unit is coupled to the (6p−5)th scan line and the (6n−2)th data line, the eleventh pixel unit is coupled to the (6p−4)th scan line and the (6n−1)th data line, and the twelfth pixel unit is coupled to the (6p−3)th scan line and the (6n)th data line, wherein the first pixel unit and the tenth pixel unit show grey level based on data voltage from the (6m−5)th data line and the (6n−2)th data line in response to scan voltage applied on the (6p−5)th scan line, the second pixel unit and the eleventh pixel unit show grey level based on data voltage from the (6m−4)th data line and the (6n−1) th data line in response to scan voltage applied on the (6p−4)th scan line, the third pixel unit and the twelfth pixel unit show grey level based on data voltage from the (6m−3)th data line and the (6n)th data line in response to scan voltage applied on the (6p−3)th scan line, the fourth pixel unit and the seventh pixel unit show grey level based on data voltage from the (6m−2)th data line and the (6n−5)th data line in response to scan voltage applied on the (6p−2)th scan line, the fifth pixel unit and the eighth pixel unit show grey level based on data voltage from the (6m−1)th data line and the (6n−4)th data line in response to scan voltage applied on the (6p−1)th scan line, and the sixth pixel unit and the ninth pixel unit show grey level based on data voltage from the (6m)th data line and the (6n−3)th data line in response to scan voltage applied on the (6p)th scan line.

2. The LCD device of claim 1, wherein the second pixel unit is adjacent to the first pixel unit, the third pixel unit is adjacent to the second pixel unit and so forth in a sequential order, while the eighth pixel unit is adjacent to the seventh pixel unit, the ninth pixel unit is adjacent to the eighth pixel unit and so forth in a sequential order.

3. The LCD device of claim 1, wherein a first polarity data voltage is applied to the first, third, fifth, seventh, ninth, and eleventh pixel units while a second polarity data voltage is applied to the second, fourth, sixth, eighth, tenth, and twelfth pixel units, where a polarity of the first polarity data voltage is inversed to that of second polarity data voltage.

* * * * *